US011645988B2

(12) United States Patent
Kang

(10) Patent No.: US 11,645,988 B2
(45) Date of Patent: May 9, 2023

(54) PIXEL DRIVING METHOD, PIXEL DRIVING APPARATUS AND COMPUTER DEVICE

(71) Applicant: HKC CORPORATION LIMITED, Shenzhen (CN)

(72) Inventor: Chih Tsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 217 days.

(21) Appl. No.: 17/273,296

(22) PCT Filed: Dec. 17, 2018

(86) PCT No.: PCT/CN2018/121526
§ 371 (c)(1),
(2) Date: Mar. 3, 2021

(87) PCT Pub. No.: WO2020/103243
PCT Pub. Date: May 28, 2020

(65) Prior Publication Data

US 2021/0327374 A1 Oct. 21, 2021

(30) Foreign Application Priority Data

Nov. 20, 2018 (CN) ..... 201811383640.X

(51) Int. Cl.
*G09G 3/36* (2006.01)
*G09G 3/20* (2006.01)

(52) U.S. Cl.
CPC ..... *G09G 3/3607* (2013.01); *G09G 3/2007* (2013.01); *G09G 2300/0447* (2013.01);
(Continued)

(58) Field of Classification Search
None
See application file for complete search history.

(56) References Cited

U.S. PATENT DOCUMENTS 7,893,904 B2 * 2/2011 Shih ..... G09G 5/06 345/694
9,761,167 B2 * 9/2017 Chen ..... G09G 3/3611
(Continued)

FOREIGN PATENT DOCUMENTS

CN 106531092 A 3/2017
CN 107154240 A 9/2017
(Continued)

OTHER PUBLICATIONS

Feng Liu, the ISA written comments, Aug. 2019, CN.
Feng Liu, the International Search Report, dated Aug. 2019, CN.

*Primary Examiner* — Parul H Gupta

(57) ABSTRACT

A pixel driving method is provided and the method includes following steps: acquiring a pixel signal of each unit pixel in a pixel block, acquiring a first average pixel signal of the pixel block according to the pixel signal of each of the unit pixels in the pixel block, and if a signal determination interval corresponding to the first average pixel signal is a first-type interval, determining that the pixel signal of the pixel block meets a first condition; and loading first-type gray-scale signals to a part of unit pixels of the pixel block and loading second-type gray-scale signals to the remaining unit pixels of the pixel block based on a preset rule. The display quality is improved by controlling the unit pixel proportion loaded with the first-type gray-scale signal and the second-type gray-scale signal and reducing the difference among pixel signals.

6 Claims, 10 Drawing Sheets

(52) U.S. Cl.
CPC ..... *G09G 2300/0452* (2013.01); *G09G 2310/027* (2013.01); *G09G 2320/0242* (2013.01); *G09G 2360/16* (2013.01)

(56) References Cited

U.S. PATENT DOCUMENTS

| | | | | |
|---|---|---|---|---|
| 10,078,250 | B2 * | 9/2018 | Ruan | G09G 3/20 |
| 10,262,569 | B2 * | 4/2019 | Watanabe | G09G 3/3413 |
| 10,553,165 | B2 * | 2/2020 | Guan | G06T 7/90 |
| 2016/0078798 | A1 * | 3/2016 | Watanabe | G09G 3/3413 345/88 |
| 2017/0039914 | A1 * | 2/2017 | Chen | G09G 3/2003 |
| 2018/0052353 | A1 * | 2/2018 | Ruan | G09G 3/3406 |
| 2018/0174535 | A1 * | 6/2018 | Chen | G09G 3/3611 |

FOREIGN PATENT DOCUMENTS

| | | | |
|---|---|---|---|
| CN | 107256699 | A | 10/2017 |
| CN | 108510951 | A | 9/2018 |

* cited by examiner

| R | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Rave-1

Rave-i

| Rave | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Gave-1

Gave-j

| Gave | GH | GL |
|---|---|---|
| 0 | GH0 | GL0 |
| 1 | GH1 | GL1 |
| 2 | GH2 | GL2 |
| 3 | GH3 | GL3 |
| 4 | GH4 | GL4 |
| 5 | GH5 | GL5 |
| ⋮ | ⋮ | ⋮ |
| 50 | GH50 | GL50 |
| 51 | GH51 | GL51 |
| 52 | GH52 | GL52 |
| ⋮ | ⋮ | ⋮ |
| 253 | GH253 | GL253 |
| 254 | GH254 | GL254 |
| 255 | GH255 | GL255 |

| | R"ave | RM" | RL" |
|---|---|---|---|
| Rave-1 | 0 | RM"0 | RL"0 |
| | 1 | RM"1 | RL"1 |
| | 2 | RM"2 | RL"2 |
| | 3 | RM"3 | RL"3 |
| | 4 | RM"4 | RL"4 |
| | 5 | RM"5 | RL"5 |
| | ⋮ | ⋮ | ⋮ |
| | 50 | RM"50 | RL"50 |
| | 51 | RM"51 | RL"51 |
| | 52 | RM"52 | RL"52 |
| | ⋮ | ⋮ | ⋮ |
| Rave-i | 253 | RM"253 | RL"253 |
| | 254 | RM"254 | RL"254 |
| | 255 | RM"255 | RL"255 |

FIG. 10

| | R'ave | RM' | RH' |
|---|---|---|---|
| Rave-1 | 0 | RM'0 | RH'0 |
| | 1 | RM'1 | RH'1 |
| | 2 | RM'2 | RH'2 |
| | 3 | RM'3 | RH'3 |
| | 4 | RM'4 | RH'4 |
| | 5 | RM'5 | RH'5 |
| | ⋮ | ⋮ | ⋮ |
| | 50 | RM'50 | RH'50 |
| | 51 | RM'51 | RH'51 |
| | 52 | RM'52 | RH'52 |
| | ⋮ | ⋮ | ⋮ |
| Rave-i | 253 | RM'253 | RH'253 |
| | 254 | RM'254 | RH'254 |
| | 255 | RM'255 | RH'255 |

FIG. 11

PIXEL DRIVING METHOD, PIXEL DRIVING APPARATUS AND COMPUTER DEVICE

CROSS REFERENCE OF RELATED APPLICATIONS

This application claims the priority to the Chinese Patent Application No. 201811383640.X, filed with National Intellectual Property Administration, PRC on, Nov. 20, 2018 and entitled "PIXEL DRIVING METHOD, PIXEL DRIVING APPARATUS AND COMPUTER DEVICE", which is incorporated herein by reference in its entirety.

TECHNICAL FIELD

The present application relates to a pixel driving method, a pixel driving apparatus and a computer device.

BACKGROUND

The statements herein merely provide background information related to the present application and do not necessarily constitute the conventional art.

Currently, a Vertical Alignment (VA) liquid crystal technology or an In-Plane Switching (IPS) liquid crystal technology is mostly adopted for a large-sized display panel. The Vertical Alignment (VA) liquid crystal technology has higher production efficiency and lower cost compared with the In-Plane Switching (IPS) liquid crystal technology; however, it has more obvious defects compared with the In-Plane Switching (IPS) liquid crystal technology in optical property, especially when the large-sized display panel needs a larger viewing angle to be displayed in commercial application. As shown in FIG. 1, when the Vertical Alignment (VA) liquid crystal technology is adopted for display driving, the lightness at a large viewing angle is rapidly saturated with a signal (as shown in a curve 2), which causes the quality contrast and color shift at the large viewing angle to be worse than that at a positive viewing angle (as shown in a curve 1, lightness variation with a signal at the positive viewing angle).

Currently, the pixel driving method provided by the example technique may cause the image to have graininess due to the alternation of the bright sub-pixels and dark sub-pixels.

SUMMARY

An object of the present application is to provide an array substrate, a display panel and a method for manufacturing the array substrate to avoid graininess during screen display and thereby improve display quality.

A pixel driving method, a pixel driving apparatus and a computer device.

In one aspect, the embodiments of the present application provide a pixel driving method, and the method includes:

acquiring a pixel signal of each unit pixel in a pixel block;

acquiring a first average pixel signal of the pixel block based on the pixel signal of each unit pixel in the pixel block;

if a signal determination interval corresponding to the first average pixel signal is a first-type interval, determining that the pixel signal of the pixel block meets a first condition, where the signal determination interval includes the first-type interval, and the first condition is used for representing the graininess of the pixel block during display; and if determining that the pixel signal of the pixel block meets the first condition, loading first-type gray-scale signals to a part of unit pixels of the pixel block and loading second-type gray-scale signals to the remaining unit pixels of the pixel block based on a preset rule, where the first-type gray-scale signals are not equal to the corresponding second-type gray-scale signals.

According to the pixel driving method provided by the embodiments of the present application, a new first-type gray-scale signal and a new second-type gray-scale signal are loaded to each unit pixel in the pixel block by determining whether the pixel block has graininess during display, and the graininess of the pixel block during display is improved by controlling the unit pixel proportion for loading the first-type gray-scale signal and the second-type gray-scale signal and reducing the difference among pixel signals.

In one or more embodiments, the unit pixel includes a red sub-pixel, a green sub-pixel and a blue sub-pixel, and the pixel driving method further includes:

if the signal determination interval corresponding to the first average pixel signal is a second-type interval, determining that a pixel signal of a pixel block does not meet a first condition, where the signal determination interval includes the second-type interval; and if determining that the pixel signal of the pixel block does not meet the first condition, loading a first-type gray-scale signal and a second-type gray-scale signal respectively to two adjacent same-color sub-pixels of each first grouping unit in the pixel block;

where the first grouping unit includes two adjacent unit pixels, and no same unit pixel exists in each first grouping unit.

In one or more embodiments, the step of acquiring a first-type gray-scale signal and a second-type gray-scale signal includes:

if determining that the pixel signal of the pixel block meets the first condition, acquiring an average pixel signal of each second grouping unit in the pixel block, where the second grouping unit includes four adjacent unit pixels, and no same unit pixel exists in each second grouping unit; and acquiring a first-type gray-scale signal and a second-type gray-scale signal corresponding to the average pixel signal of each second grouping unit by looking up a table.

In one or more embodiments, the step of acquiring a first-type gray-scale signal and a second-type gray-scale signal includes:

if determining that the pixel signal of the pixel block does not meet the first condition, acquiring an average pixel signal of each first grouping unit in the pixel block; and acquiring the first-type gray-scale signal and the second-type gray-scale signal corresponding to the average pixel signal of each first grouping unit by looking up a table.

In one or more embodiments, the unit pixel includes a red sub-pixel; the step of loading first-type gray-scale signals to a part of unit pixels of the pixel block and loading second-type gray-scale signals to the remaining unit pixels of the pixel block based on a preset rule includes:

loading the first-type gray-scale signals to three red sub-pixels in each second grouping unit and loading the second-type gray-scale signal to the remaining one red sub-pixel, where the second grouping unit includes four adjacent unit pixels, and no same unit pixel exists in each second grouping unit.

In one or more embodiments, the unit pixel includes a green sub-pixel; the step of loading first-type gray-scale signals to a part of unit pixels of the pixel block and loading second-type gray-scale signals to the remaining unit pixels of the pixel block based on a preset rule includes:

loading the first-type gray-scale signals to three green sub-pixels in each second grouping unit and loading the second-type gray-scale signal to the remaining one green sub-pixel.

In one or more embodiments, the unit pixel includes a blue sub-pixel; the step of loading first-type gray-scale signals to a part of unit pixels of the pixel block and loading second-type gray-scale signals to the remaining unit pixels of the pixel block based on a preset rule includes:

loading the first-type gray-scale signal and the second-type gray-scale signal respectively to blue sub-pixels of each first grouping unit in the pixel block, where the first grouping unit includes two adjacent unit pixels, and no same unit pixel exists in each first grouping unit.

In one or more embodiments, before the step of acquiring a pixel signal of each unit pixel in the pixel block, the method further includes:

loading a group of initial high and initial low gray-scale signals respectively to unit pixels in the first grouping unit of the pixel block, where the first grouping unit includes two adjacent unit pixels, and no same unit pixel exists in each first grouping unit.

A pixel driving apparatus includes:

a pixel signal acquisition circuit for acquiring a pixel signal of each unit pixel in a pixel block;

an average pixel signal acquisition circuit for acquiring a first average pixel signal of the pixel block based on the pixel signal of each unit pixel in the pixel block;

a graininess determination circuit for determining that the pixel signal of the pixel block meets a first condition when a signal determination interval corresponding to the first average pixel signal is a first-type interval, where the signal determination interval includes the first-type interval, and the first condition is used for representing the graininess of the pixel block during display; and a driving signal loading circuit for loading first-type gray-scale signals to a part of unit pixels of the pixel block and loading second-type gray-scale signals to the remaining unit pixels of the pixel block based on a preset rule when determining that the pixel signal of the pixel block meets the first condition, where the first-type gray-scale signals are not equal to the corresponding second-type gray-scale signals.

A computer device includes a memory having computer-readable instructions stored therein and one or more processors, where the computer-readable instructions, when executed by the one or more processors, cause the one or more processors to perform steps of the method as shown in FIG. 5:

acquiring a pixel signal of each unit pixel in a pixel block;

acquiring a first average pixel signal of the pixel block based on the pixel signal of each unit pixel in the pixel block;

if a signal determination interval corresponding to the first average pixel signal is a first-type interval, determining that the pixel signal of the pixel block meets a first condition, where the signal determination interval includes the first-type interval, and the first condition is used for representing the graininess of the pixel block during display; and if determining that the pixel signal of the pixel block meets the first condition, loading first-type gray-scale signals to a part of unit pixels of the pixel block and loading second-type gray-scale signals to the remaining unit pixels of the pixel block based on a preset rule, where the first-type gray-scale signals are not equal to the corresponding second-type gray-scale signals.

In one or more embodiments, a processor when, executing the computer readable instructions, further performs the steps of:

if the signal determination interval corresponding to the first average pixel signal is a second-type interval, determining that a pixel signal of a pixel block does not meet a first condition, where the signal determination interval includes the second-type interval; and if determining that the pixel signal of the pixel block does not meet the first condition, loading a first-type gray-scale signal and a second-type gray-scale signal respectively to two adjacent same-color sub-pixels of each first grouping unit in the pixel block;

where the first grouping unit includes two adjacent unit pixels, and no same unit pixel exists in each first grouping unit.

In one or more embodiments, a processor when, executing the computer readable instructions, further performs the steps of:

if determining that the pixel signal of the pixel block meets the first condition, acquiring an average pixel signal of each second grouping unit in the pixel block, where the second grouping unit includes four adjacent unit pixels, and no same unit pixel exists in each second grouping unit; and acquiring a first-type gray-scale signal and a second-type gray-scale signal corresponding to the average pixel signal of each second grouping unit by looking up a table.

In one or more embodiments, a processor when, executing the computer readable instructions, further performs the steps of:

if determining that the pixel signal of the pixel block does not meet the first condition, acquiring an average pixel signal of each first grouping unit in the pixel block; and acquiring the first-type gray-scale signal and the second-type gray-scale signal corresponding to the average pixel signal of each first grouping unit by looking up a table.

In one or more embodiments, a processor when, executing the computer readable instructions, further performs the steps of:

loading the first-type gray-scale signals to three red sub-pixels in each second grouping unit and loading the second-type gray-scale signal to the remaining one red sub-pixel, where the second grouping unit includes four adjacent unit pixels, and no same unit pixel exists in each second grouping unit.

In one or more embodiments, a processor when, executing the computer readable instructions, further performs the steps of:

loading the first-type gray-scale signals to three green sub-pixels in each second grouping unit and loading the second-type gray-scale signal to the remaining one green sub-pixel.

In one or more embodiments, a processor when, executing the computer readable instructions, further performs the steps of:

loading the first-type gray-scale signal and the second-type gray-scale signal respectively to blue sub-pixels of each first grouping unit in the pixel block, where the first grouping unit includes two adjacent unit pixels, and no same unit pixel exists in each first grouping unit.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can acquire other drawings according to the drawings without any inventive labor.

FIG. 10 is a table showing the relationship between the first-type gray-scale signal and the second-type gray-scale signal corresponding to each average pixel signal according to another embodiment;

FIG. 11 is a table showing the relationship between the first-type gray-scale signal and the second-type gray-scale signal corresponding to each average pixel signal according to yet another embodiment;

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are only for explaining, but not for limiting the present application.

It should be noted that when an element is referred to as being "connected to" another element, it can be directly connected to the other element, or an intervening element may also be present. The terms "mounted", "one end", "the other end" and the like as used herein are for illustration purposes only.

Unless defined otherwise, all technical and scientific terms used herein have the same meaning as commonly understood by one of ordinary skill in the art to which the present application belongs. The term used in the specification of the present application herein is for the purpose of describing particular embodiment only and is not intended to be limiting of the present application. As used herein, the term "and/or" includes any and all combinations of one or more of the associated listed items.

Figure 1:
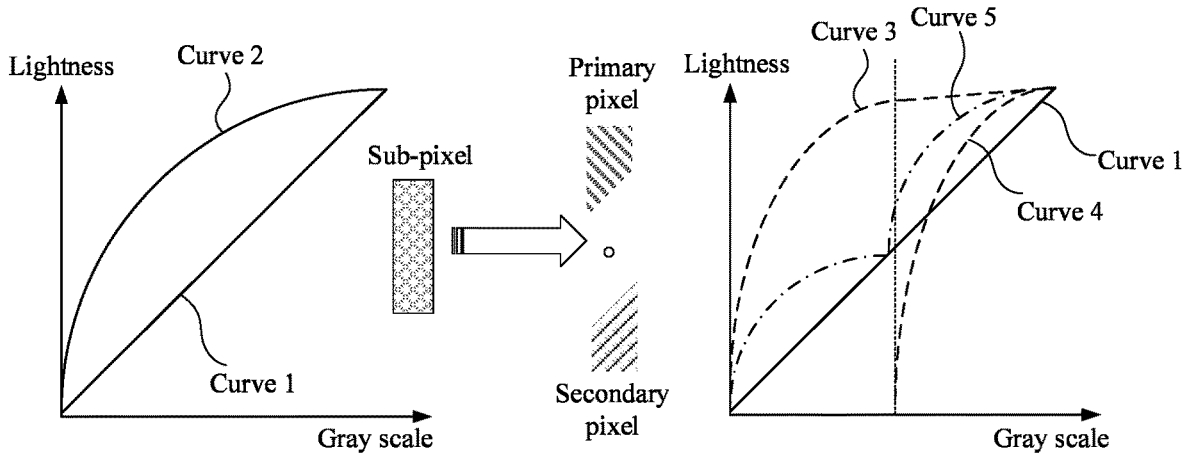
FIG. 1 shows the display lightness of pixels varying with gray-scale signals at a positive viewing angle and a large viewing angle when a VA liquid crystal technology is adopted for display driving.
Figure 2:
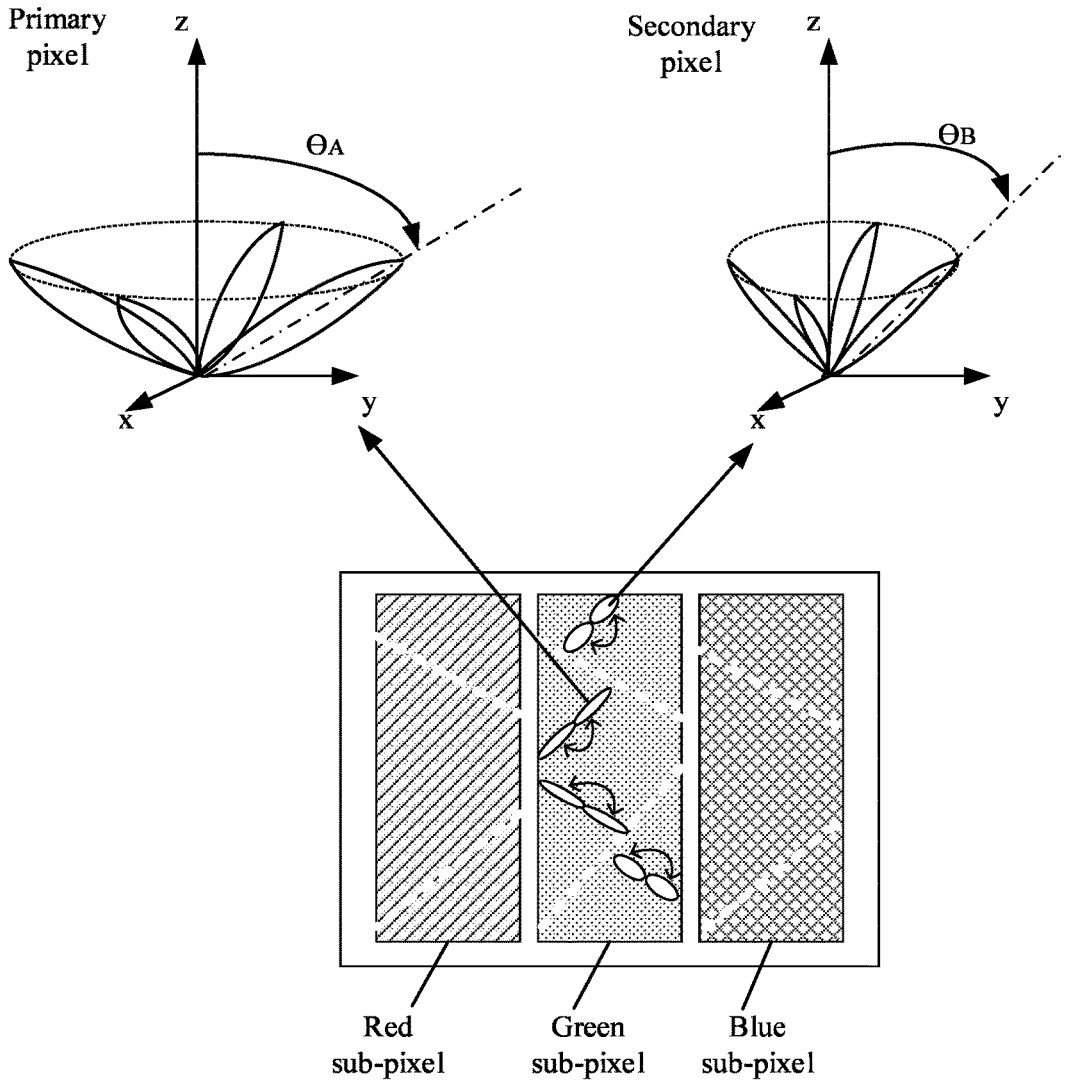
FIG. 2 shows the display lightness of primary pixels and secondary pixels varying with gray-scale signals at the positive viewing angle and the large viewing angle when the primary pixels and the secondary pixels are driven by respectively loading different gray-scale signals.

In an example technique, two adjacent red sub-pixels (green sub-pixels/blue sub-pixels) are divided into primary pixels and secondary pixels, and then different gray-scale voltages are applied to the primary pixels and the secondary pixels, as shown in FIG. 1. When the divided primary pixels and secondary pixels applied with different gray-scale voltages are driven (curve 3 is the variation of the primary pixels' lightness with signals, and curve 4 is the variation of the secondary pixels' lightness with signals), the curve (curve 5) in which side-view lightness of the display panel composed of the primary pixels and secondary pixels varies with signals is closer to curve (curve 1) in which positive-view lightness varies with signals, as shown in FIG. 2. Taking green sub-pixels as an example, the defect of the color shift of viewing angle can be solved by spatially designing the primary pixels and secondary pixels and applying different driving signals to them.

Figures 3, 4:
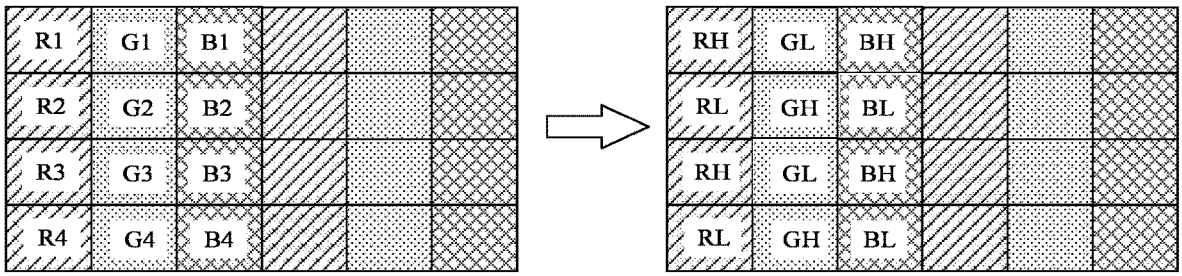
FIG. 3 is a schematic diagram of pixel voltage distribution of the primary pixels and the secondary pixels of a pixel driving method according to an embodiment.
FIG. 4 is a table showing a relationship between the high and low gray-scale signals respectively loaded to the primary pixels and the secondary pixels and the average pixel signal according to an embodiment.

Referring to FIG. 3, for the red sub-pixel, by sacrificing spatial resolution, a group of high and low gray-scale signals RH and RL can be used to replace signals of original sub-pixels R1 and R2, and the combination of the high and low gray-scale signals can achieve the effect of improving the color shift of viewing angle. At the positive viewing angle, the average lightness of the group of high and low gray-scale signals RH and RL can maintain the same as that of the original two independent sub-pixel signals R1 and R2. Referring to FIG. 4, taking 8-bit display driver as an example, the gray-scale signal of each sub-pixel is 0, 1, . . . , or 255, the two original independent sub-pixel signals R1, R2 are also gray-scale signals in 0, 1, . . . , 255, the average signal Rave of two adjacent same-color sub-pixels R1, R2 is also a gray-scale signals that is 0, 1, . . . , or 255, and a group of high and low gray-scale signals RH and RL corresponding to the average signal Rave of two adjacent sub-pixels can be found by looking up a table. As shown in FIG. 3, two adjacent same-color sub-pixels are driven to display by high and low gray-scale signals, respectively. In summary of the implementation process of the present applicant, it is found that the above-mentioned manner of driving each sub-pixel by high and low gray-scale signal spatially can improve the color shift of viewing angle. However, due to the alternation of bright and dark sub-pixels, when the lightness difference of the bright and dark sub-pixels is large, the graininess during display is easily occurred, thus the display quality cannot be ensured.

Based on the above, it is desirable to provide a pixel driving method, a pixel driving apparatus, a computer device, and a computer-readable storage medium for solving a problem of the graininess in image display.

Figure 5:
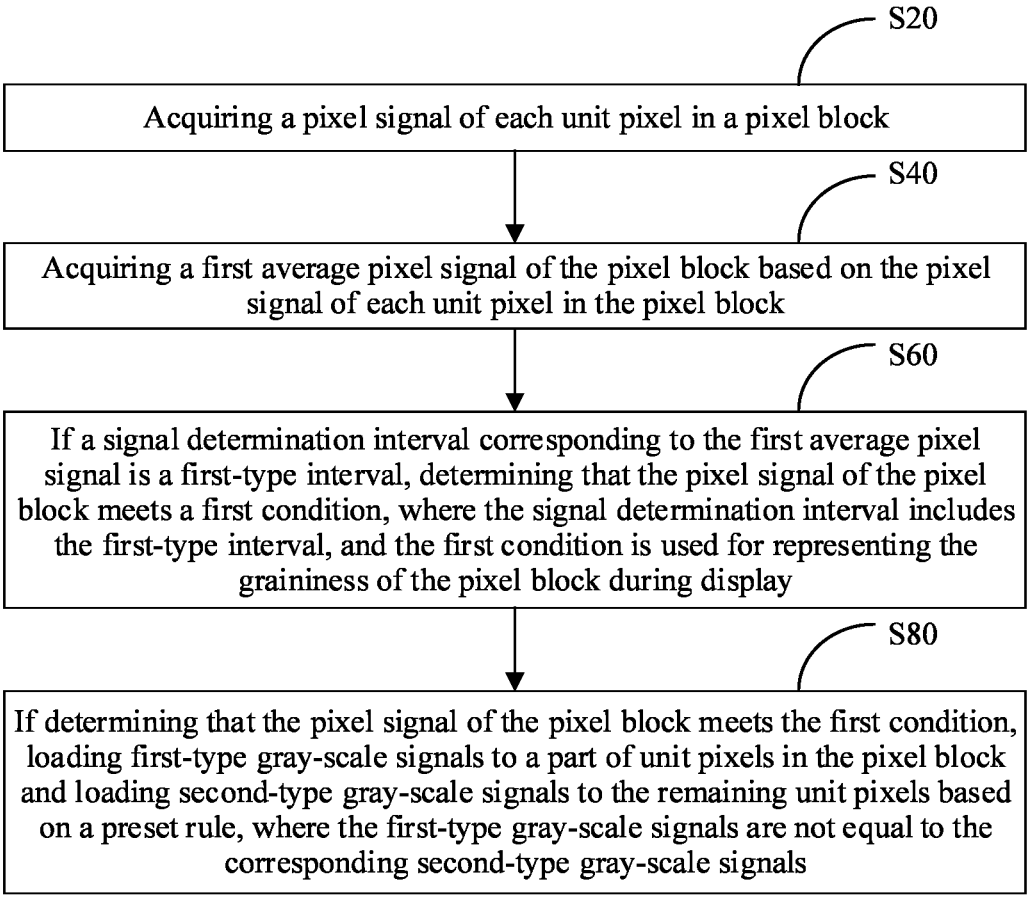
FIG. 5 is a flow schematic diagram of a pixel driving method according to an embodiment.

In one aspect, as shown in FIG. 5, the embodiments of the present application provide a pixel driving method, and the method includes:

S20: acquiring a pixel signal of each unit pixel in a pixel block;

S40: acquiring a first average pixel signal of the pixel block based on the pixel signal of each unit pixel in the pixel block;

S60: if a signal determination interval corresponding to the first average pixel signal is a first-type interval, determining that the pixel signal of the pixel block meets a first condition, where the signal determination interval includes the first-type interval, and the first condition is used for representing the graininess of the pixel block during display; and S80: if determining that the pixel signal of the pixel block meets the first condition, loading first-type gray-scale signals to a part of unit pixels of the pixel block and loading second-type gray-scale signals to the remaining unit pixels of the pixel block based on a preset rule, where the first-type gray-scale signals are not equal to the corresponding second-type gray-scale signals.

The pixel block may be a block including a plurality of unit pixels, for example, one pixel block may be a block in units of n*m unit pixels. The unit pixel includes one or more sub-pixels, for example, the unit sub-pixel may include a red sub-pixel, a green sub-pixel and/or a blue sub-pixel. The unit pixel may further include a white sub-pixel and the like. The signal determination interval is a reference for determining whether a pixel block consisting of each unit pixel has graininess during display, and each signal determination interval corresponds to a plurality of average pixel signals. The first-type interval is used for representing an interval in which when the lightness difference of high and low gray-scale signals loaded to each unit pixel in the pixel block is large, and the proportion of sub-pixels loaded with the high and low gray-scale signals is substantially the same, the graininess is obvious during overall display.

Figures 6, 7:
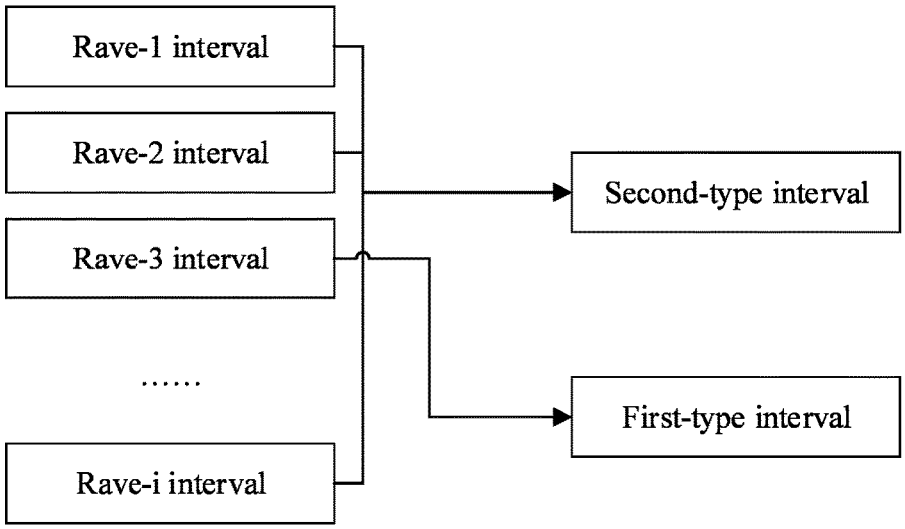
FIG. 6 is a table showing a relationship between a first-type gray-scale signal and a second-type gray-scale signal corresponding to each average pixel signal according to an embodiment.
FIG. 7 is a schematic diagram illustrating a relationship between signal determination intervals and interval types according to an embodiment.

Taking the red sub-pixel and the green sub-pixel in each unit pixel as an example, as shown in FIG. 6, the average pixel signal Rave of the red sub-pixel is divided into a plurality of intervals: Rave-1, Rave-2, . . . and Rave-i. For some intervals, when the lightness difference of high and low gray-scale signals loaded to each unit pixel in the pixel block is large, and the proportion of sub-pixels loaded with the high and low gray-scale signals is the same, the graininess is obvious during overall display. $R_{ave\text{-}1}$ may correspond to an interval where the average pixel signal Rave is 0 to 5. The preset rule is a rule preset by experiences such as experiments and used to direct the adjustment of the difference value of the first-type gray-scale signal and the second-type gray-scale signal loaded to each unit pixel and the adjustment of the proportion of the sub-pixels loaded with the first-type gray-scale signal and the second-type gray-scale signal in the pixel block so as to weaken the graininess of the pixel block during display. The first-type gray-scale signal and the second-type gray-scale signal are set correspondingly, that is, each first-type gray-scale signal corresponds to a second-type gray-scale signal, and the value of the first-type gray-scale signal is not equal to that of the corresponding second-type gray-scale signal. Optionally, the average signal of each unit pixel corresponds to a group of first-type and second-type gray-scale signals.

Specifically, the pixel signal of each unit pixel in the pixel block is first acquired, that is, an original independent sub-pixel gray-scale signal of each pixel block is acquired, and then the average pixel signal of all unit pixels of the pixel block, namely a first average pixel signal, is acquired, as shown in FIG. 7, then whether the signal determination interval where the first average pixel signal is located is the first-type interval is determined according to the first average pixel signal and the signal determination interval, if so, it is indicated that visual graininess of the pixel block may exist during the overall display, and the first-type gray-scale signals are reloaded to a part of unit pixels of the pixel block and the second type gray-scale signals are loaded to another part of unit pixels based on the preset rule, followed by that the graininess of the pixel block during display is reduced by reducing the difference of the gray-scale signal loaded to each sub-pixel of the pixel block and adjusting the proportion of the loaded high and low gray-scale signals.

Figure 8:
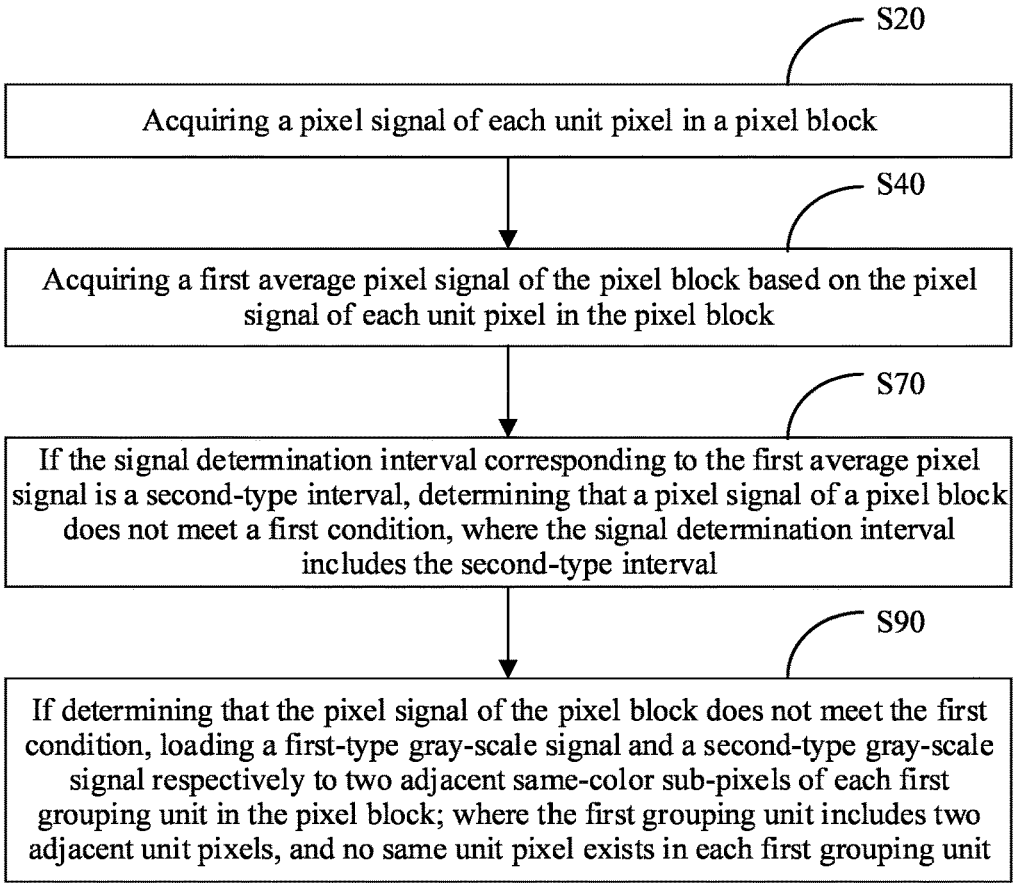
FIG. 8 is a flow schematic diagram illustrating a pixel driving method according to another embodiment.
Figure 9:
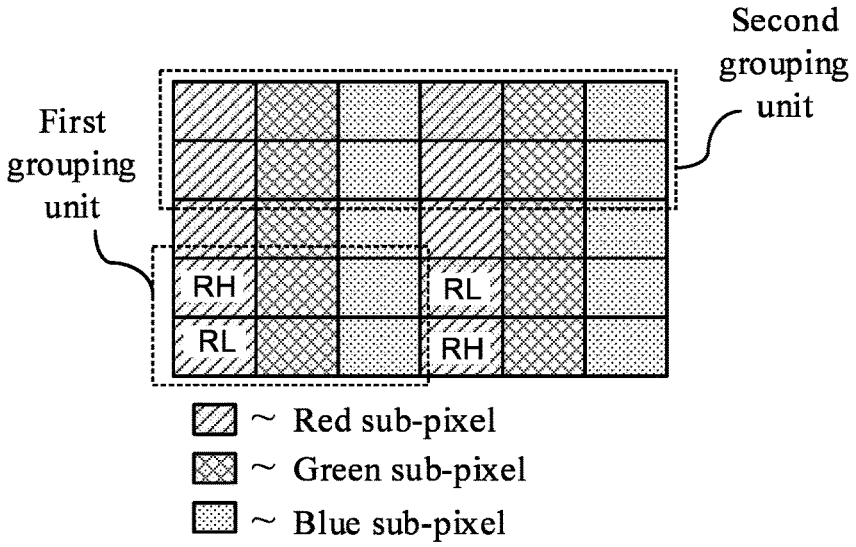
FIG. 9 is a schematic diagram of loading a gray-scale signal to each sub-pixel according to an embodiment.

In one or more embodiments, as shown in FIGS. 8 and 9, the unit pixel includes a red sub-pixel, a green sub-pixel, and a blue sub-pixel, and the pixel driving method further includes:

S70: if the signal determination interval corresponding to the first average pixel signal is a second-type interval, determining that the pixel signal of the pixel block does not meet a first condition, where the signal determination interval includes the second-type interval; and S90: if determining that the pixel signal of the pixel block does not meet the first condition, loading a first-type gray-scale signal and a second-type gray-scale signal respectively to two adjacent same-color sub-pixels of each first grouping unit in the pixel block;

where the first grouping unit includes two adjacent unit pixels, and no same unit pixel exists in each first grouping unit.

According to the acquired pixel signal of each unit pixel, an average pixel signal of the whole pixel block can be acquired and referred as a first average pixel signal, then a signal determination interval corresponding to the first average pixel signal is acquired, and then whether the signal determination interval is a second-type interval is determined, as shown in FIG. 7, if so, it is indicated that visual graininess of the pixel block does not exist during display, and for the pixel block without graininess during display, as shown in FIG. 9, the pixel signals of the original adjacent same-color sub-pixels in each first grouping unit may be replaced with a group of first-type and second-type gray-scale signals corresponding to the average pixel signal of every two adjacent same-color sub-pixels, so that the pixel block can effectively overcome color shift of a viewing angle during display, and thus improving the display quality. For example, for the red sub-pixel, if it is determined that the pixel block has no graininess during display, new driving voltages can be applied to each sub-pixel according to the first-type gray-scale signal and the second-type gray-scale signal corresponding to the average pixel signal in FIG. 6, 10 or 11, so as to ensure the display effect at a large viewing angle and improve the color shift.

Figure 12:
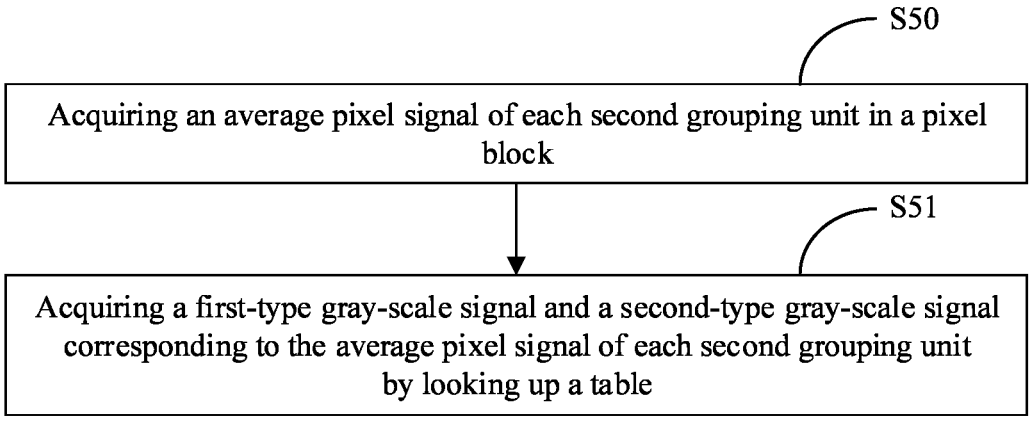
FIG. 12 is a flow schematic diagram illustrating a step of acquiring a first-type gray-scale signal and a second-type gray-scale signal according to an embodiment.

In one or more embodiments, as shown in FIG. 12, the step of acquiring a first-type gray-scale signal and a second-type gray-scale signal includes:

S50: if determining that the pixel signal of the pixel block meets the first condition, acquiring an average pixel signal of each second grouping unit in the pixel block, where the second grouping unit includes four adjacent unit pixels, and no same unit pixel exists in each second grouping unit; and S51: acquiring a first-type gray-scale signal and a second-type gray-scale signal corresponding to the average pixel signal of each second grouping unit by looking up a table.

If determining that the corresponding pixel block has graininess during display, as shown in FIG. 10, a group of first-type and second-type gray-scale signals corresponding to the average pixel signals of 4 adjacent unit pixels in each second grouping unit (as shown in FIG. 9) of the pixel block can be acquired by looking up a table. If determining that a pixel voltage of the pixel block meets the first condition, that is, the pixel block has graininess during display, the 4 adjacent unit pixels can be driven by using 3 first-type gray-scale signals and 1 second-type gray-scale signal. The proportion of the sub-pixels with large lightness difference of high and low signal in the pixel block is reduced, so that the graininess does not exist during overall display.

Figure 13:
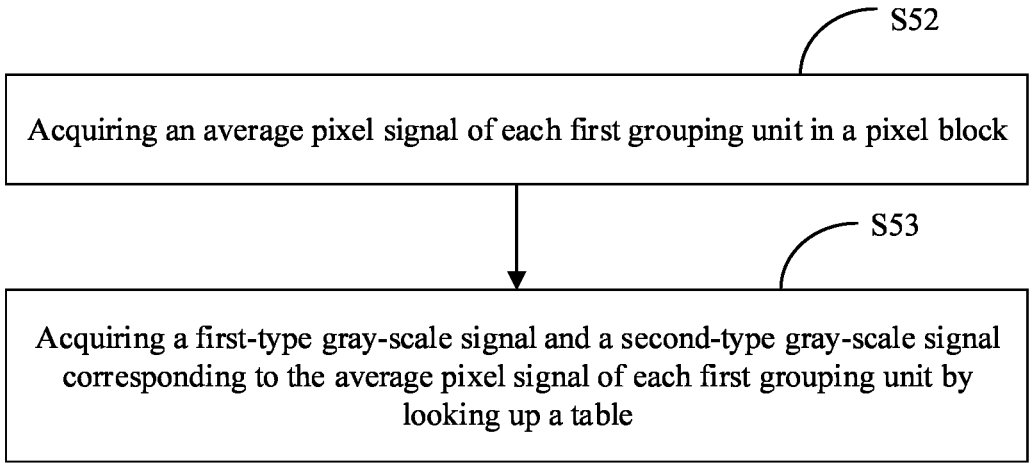
FIG. 13 is a flow schematic diagram illustrating a step of acquiring a first-type gray-scale signal and a second-type gray-scale signal according to another embodiment.

In one or more embodiments, as shown in FIG. 13, the step of acquiring a first-type gray-scale signal and a second-type gray-scale signal includes:

S52: if determining that the pixel signal of the pixel block does not meet the first condition, acquiring an average pixel signal of each first grouping unit in the pixel block; and S53: acquiring a first-type gray-scale signal and a second-type gray-scale signal corresponding to the average pixel signal of each first grouping unit by looking up a table.

If determining that the corresponding pixel block has no graininess during display, as shown in FIG. 11, a group of first-type and second-type gray-scale signals corresponding to the average pixel signal of 2 adjacent unit pixels in each first grouping unit of the pixel block can be acquired by looking up a table, providing data for subsequently loading of the gray-scale signal to each sub-pixel. Optionally, one first-type gray-scale signal and one second-type gray-scale signal may be used to drive the two adjacent unit pixels, so that the pixel block has a good display effect at a wide viewing angle during display.

Figure 14:
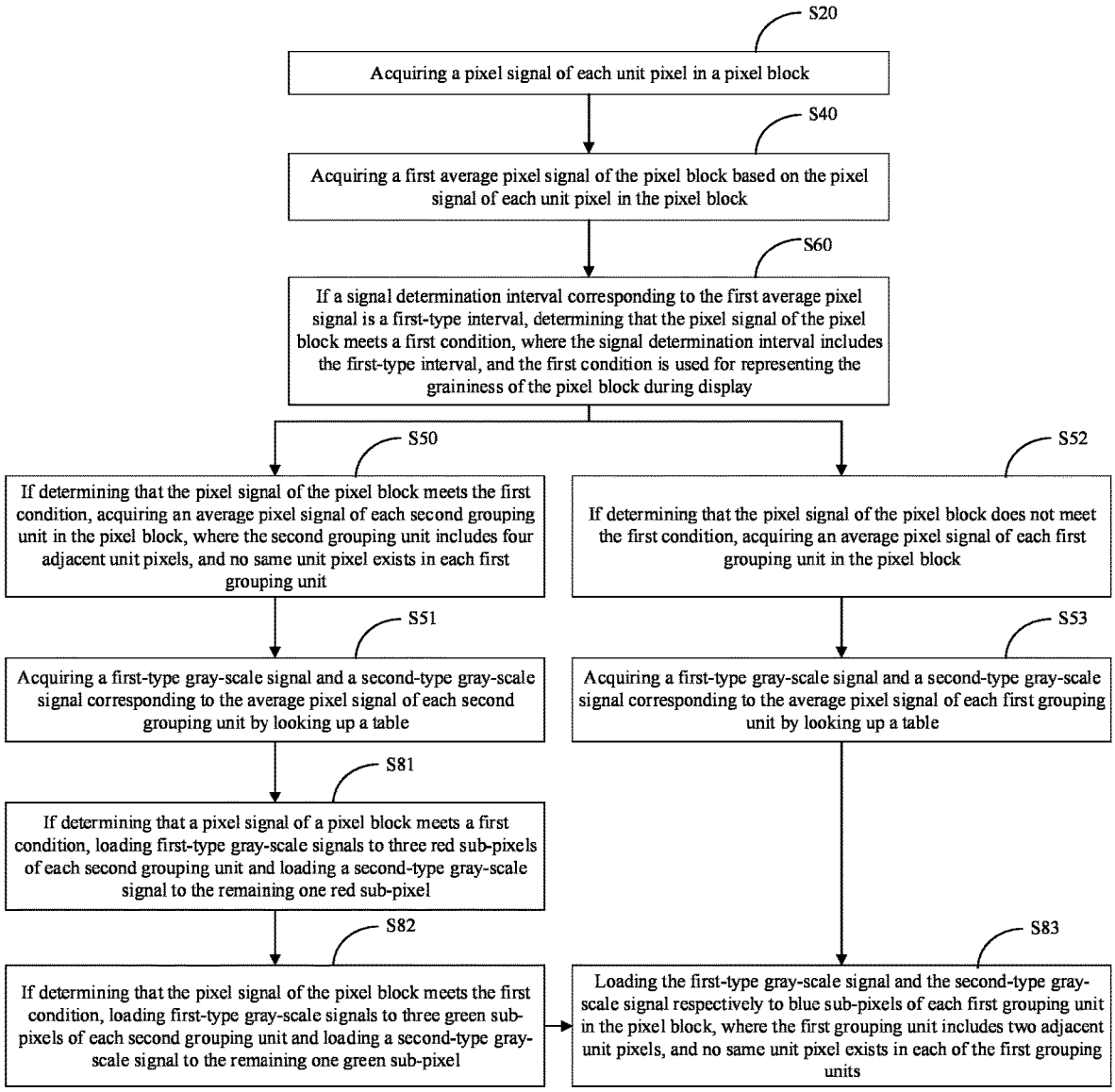
FIG. 14 is a flow schematic diagram illustrating a pixel driving method according to another embodiment.

In one or more embodiments, as shown in FIG. 14, the unit pixel includes a red sub-pixel; the step of loading first-type gray-scale signals to a part of unit pixels of the pixel block and loading second-type gray-scale signals to the remaining unit pixels of the pixel block based on a preset rule includes:

S81: loading the first-type gray-scale signals to three red sub-pixels in each second grouping unit and loading the second-type gray-scale signal to the remaining one red sub-pixel, where the second grouping unit includes four adjacent unit pixels, and no same unit pixel exists in each second grouping unit.

If a certain pixel block has graininess during display, every four adjacent red sub-pixels are taken as a second sub-group unit, the first-type gray-scale signals are loaded to 3 red sub-pixels and the second-type gray-scale signal are loaded to 1 red sub-pixel according to the first-type gray-scale signals and the second-type gray-scale signals which are acquired in advance, and the proportion of the red sub-pixels with large lightness difference of high signals and low signals in the pixel block is reduced, thereby weakening the graininess during overall display and ensuring the display quality. Taking the red sub-pixel as an example, as shown in FIG. 6, the first-type gray-scale signals and the corresponding second-type gray-scale signals may be high gray-scale signals RH and low gray-scale signals RL, respectively, or as shown in FIG. 10, may be medium-low gray-scale signals RM" and low gray-scale signals RL", respectively, or as shown in FIG. 11, may be medium-low gray-scale signals RM' and high gray-scale signals RH', respectively.

In one or more embodiments, as shown in FIG. 14, the unit pixel includes a green sub-pixel; the step of loading first-type gray-scale signals to a part of unit pixels of the pixel block and loading second-type gray-scale signals to the remaining unit pixels of the pixel block based on a preset rule further includes:

S82: loading the first-type gray-scale signals to three green sub-pixels in each second grouping unit and loading the second-type gray-scale signal to the remaining one green sub-pixel.

Similarly, for the green sub-pixels in the unit pixel, if determining that the corresponding pixel block has graininess during display, the acquired first-type gray-scale signals can be loaded to three green sub-pixels in the second grouping unit and the second-type gray-scale signal can be loaded to the remaining one green sub-pixel, and the proportion of the green sub-pixels with large lightness difference of high signals and low signals in the pixel block is reduced, thereby weakening the graininess during overall display and ensuring the display quality.

In one or more embodiments, the unit pixel includes a blue sub-pixel; the step of loading first-type gray-scale signals to a part of unit pixels of the pixel block and loading second-type gray-scale signals to the remaining unit pixels of the pixel block based on a preset rule includes:

S83: loading the first-type gray-scale signal and the second-type gray-scale signal respectively to blue sub-pixels of each first grouping unit in the pixel block, where the first grouping unit includes two adjacent unit pixels, and no same unit pixel exists in each first grouping unit.

Because human eyes have low sensitivity to the variation of blue color lightness and to the difference of lightness of blue sub-pixels, for the driving signals of the blue sub-pixels, a group of first-type gray-scale signals and second-type gray-scale signals corresponding to the average pixel signal of every two adjacent blue sub-pixels can be used to respectively replace the pixel signals B1 and B2 originally loaded to the two adjacent blue sub-pixels, the combination of first-type gray-scale signals and the second-type gray-scale signals can achieve the effect of improving the color shift of viewing angle, and at the positive viewing angle, the average lightness of the group of first-type and second-type gray-scale signals can maintain the same as that of the original two independent sub-pixel signals B1 and B2.

Figure 15:
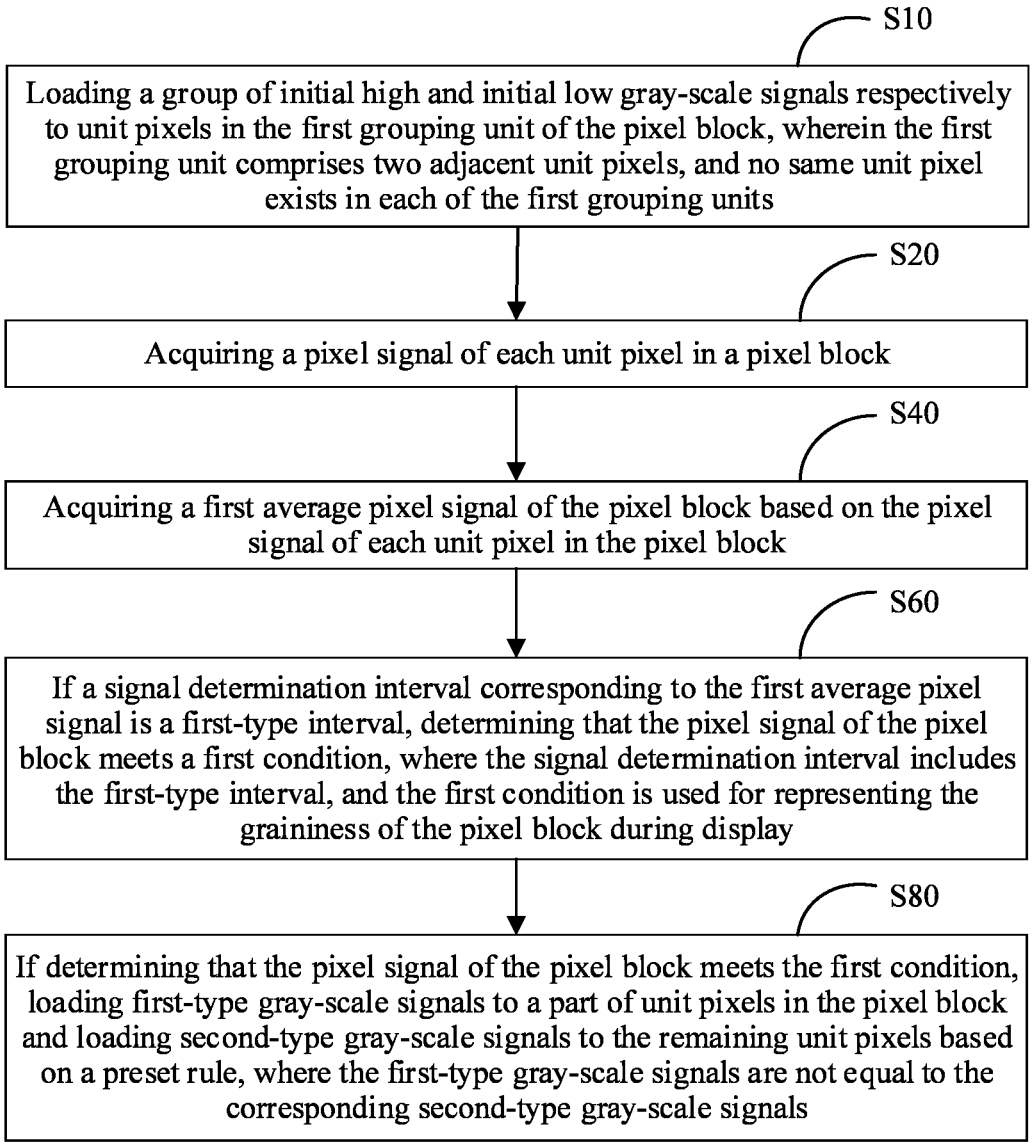
FIG. 15 is a flow schematic diagram illustrating a pixel driving method according to yet another embodiment.

In one or more embodiments, as shown in FIG. 15, before the step of acquiring a pixel signal of each unit pixel in the pixel block, the method further includes:

S10: loading a group of initial high and initial low gray-scale signals respectively to unit pixels in the first grouping unit of the pixel block, where the first grouping unit includes two adjacent unit pixels, and no same unit pixel exists in each first grouping unit.

In order to ensure the large-viewing-angle display effect when the pixel block is displayed, a group of initial high and initial low gray-scale signals are respectively loaded to every two adjacent unit pixels during initialization. And then whether the pixel block has graininess during display is determined; if so, a group of first-type and second-type gray-scale signals corresponding to the average pixel signal of every four adjacent same-color sub-pixels are acquired, and the first-type and second-type gray-scale signal are loaded to each unit pixel according to a preset rule. If not, a group of first-type and second-type gray-scale signals corresponding to the average pixel signal of every two adjacent sub-pixels can be used to replace the original initial high and initial low gray-scale signals. Or if not, the original initial high gray-scale signal and the initial low gray-scale signal can be remained unchanged; where the initial high gray-scale signal and the initial low gray-scale signal can be acquired by looking up a table. It should be noted that the loading of the initial high gray-scale signal and the loading of the initial low gray-scale signal herein are both for the same-color sub-pixels in two adjacent unit pixels.

It should be understood that although the various steps of the flow diagrams in FIGS. 5 to 15 are shown in order as indicated by arrows, the steps are not necessarily performed in order as indicated by the arrows. The steps are not limited to being performed in the exact order illustrated and, unless explicitly stated herein, may be performed in other orders. Moreover, at least some of the steps in FIGS. 5 to 15 may include multiple sub-steps or multiple stages that are not necessarily performed at the same time, but may be performed at different times, and the sub-steps or stages are not necessarily performed sequentially, but may be performed in turn or alternately with other steps or at least some of the sub-steps or stages of other steps.

Figure 16:
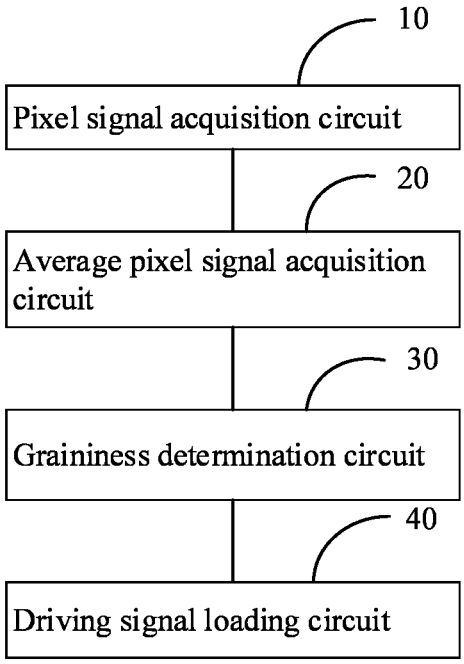
FIG. 16 is a structural schematic diagram of a pixel driving apparatus according to an embodiment.

A pixel driving apparatus, as shown in FIG. 16, includes:

a pixel signal acquisition circuit 10 for acquiring a pixel signal of each unit pixel in a pixel block;

an average pixel signal acquisition circuit 20 for acquiring a first average pixel signal of the pixel block based on the pixel signal of each unit pixel in the pixel block;

a graininess determination circuit 30 for determining that the pixel signal of the pixel block meets a first condition when a signal determination interval corresponding to the first average pixel signal is a first-type interval, where the signal determination interval includes the first-type interval, and the first condition is used for representing the graininess of the pixel block during display; and a driving signal loading circuit 40 for loading first-type gray-scale signals to a part of unit pixels of the pixel block and loading second-type gray-scale signals to the remaining unit pixels of the pixel block based on a preset rule when determining that the pixel signal of the pixel block meets the first condition, where the first-type gray-scale signals are not equal to the corresponding second-type gray-scale signals.

The definitions of the pixel block, the unit pixel, etc. are the same as those in the above embodiments, and are not repeated herein. Specifically, the pixel signal acquisition circuit 10 acquires a pixel signal of each unit pixel in the pixel block and sends the pixel signal to the average pixel signal acquisition circuit 20, and the average pixel signal acquisition circuit 20 acquires a first average pixel signal of the pixel block based on the pixel signal of each unit pixel in the pixel block; the graininess determination circuit 30 determines that the pixel signal of the pixel block meets a first condition when a signal determination interval corresponding to the first average pixel signal is a first-type interval, where the signal determination interval includes the first-type interval, and the first condition is used for representing the graininess of the pixel block during display, and then the driving signal loading circuit 40 loads the first-type gray-scale signals to a part of unit pixels of the pixel block and loads the second-type gray-scale signals to the remaining unit pixels of the pixel block based on a preset rule. According to the pixel driving apparatus provided by the embodiments of the present application, the strength of the gray-scale signal loaded to each sub-pixel of the pixel block is correspondingly adjusted by determining whether the pixel block has graininess during display, thereby weakening the graininess during the display of the display panel formed by each pixel block and improving the display quality.

Moreover, the specific definition of the pixel driving apparatus can be referred to the definition of the pixel driving method above, and will not be described herein again. The modules in the pixel driving apparatus can be wholly or partially implemented by software, hardware and a combination thereof. The above modules can be a hardware incorporated in or independent of a processor in the computer device, and can also be stored in a memory in the computer device in the form of a software, such that the processor can call and execute operations corresponding to the modules.

Figure 17:
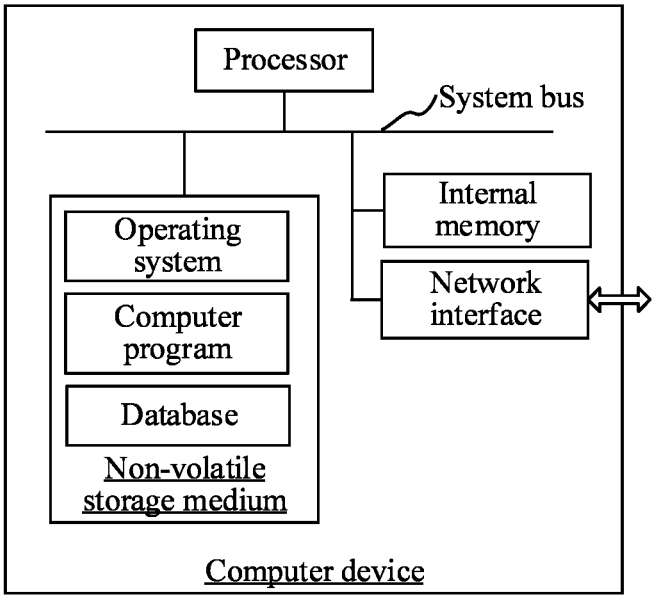
FIG. 17 is a diagram of an internal structure of a computer device according to an embodiment.

In one or more embodiments, a computer device is provided, which may be a server, and the internal structure diagram thereof may be as shown in FIG. 17. The computer device includes a processor, a memory, a network interface, and a database connected by a system bus. The processor of the computer device is configured to provide computing and controlling capabilities. The memory of the computer device includes a non-volatile storage medium and an internal memory. The non-volatile storage medium stores an operating system, a computer program, and a database. The internal memory provides an environment for the operation of the operating system and the computer program in the non-volatile storage medium. The database of the computer device is configured to store data such as a signal determination interval, a first-type gray-scale signal and a second-type gray-scale signal. The network interface of the computer device is configured to communicate with an external terminal through a network connection. The computer program is executed by the processor to implement a pixel driving method.

It will be understood by those skilled in the art that the structure shown in FIG. 17 is only a block diagram of part of structure associated with the present application, and is not intended to limit the computer device to which the present application may be applied, and that a specific computer device may include more or fewer components than shown in the FIG. 17, or may combine certain components, or have a different arrangement of components.

A computer device includes a memory having computer-readable instructions stored therein and one or more processors, where the computer-readable instructions, when executed by the one or more processors, cause the one or more processors to perform steps of the method as shown in FIG. 5:

S20: acquiring a pixel signal of each unit pixel in a pixel block;

S40: acquiring a first average pixel signal of the pixel block based on the pixel signal of each unit pixel in the pixel block;

S60: if a signal determination interval corresponding to the first average pixel signal is a first-type interval, determining that the pixel signal of the pixel block meets a first condition, where the signal determination interval includes the first-type interval, and the first condition is used for representing the graininess of the pixel block during display; and S80: if determining that the pixel signal of the pixel block meets the first condition, loading first-type gray-scale signals to a part of unit pixels of the pixel block and loading second-type gray-scale signals to the remaining unit pixels of the pixel block based on a preset rule, where the first-type gray-scale signals are not equal to the corresponding second-type gray-scale signals. When the computer device provided by the embodiments of the present application operates, the average pixel signal of sub-pixels of each color, namely the corresponding relation between the first average pixel signal and the signal determination interval, can be acquired according to the pixel signal of the sub-pixel of each pixel block, the type of the corresponding signal determination interval is determined to determine whether the pixel block has graininess during display, if the graininess exists (the corresponding signal determination interval is a first-type interval, namely the first condition is met), the first-type gray-scale signal or the second-type gray-scale signal are loaded to each unit pixel of the pixel block based on a preset rule that is stored in advance, and the proportion of the sub-pixels with large difference of high gray-scale signals and low gray-scale signals in the pixel block is adjusted, so that the graininess of the pixel block during display is reduced, and the display quality is improved.

A computer-readable storage medium has a computer program stored thereon, and the computer program, when executed by a processor, implements steps of the method as shown in FIG. 5:

S20: acquiring a pixel signal of each unit pixel in a pixel block;

S40: acquiring a first average pixel signal of the pixel block based on the pixel signal of each unit pixel in the pixel block;

S60: if a signal determination interval corresponding to the first average pixel signal is a first-type interval, determining that the pixel signal of the pixel block meets a first condition, where the signal determination interval includes the first-type interval, and the first condition is used for representing the graininess of the pixel block during display; and S80: if determining that the pixel signal of the pixel block meets the first condition, loading first-type gray-scale signals to a part of unit pixels of the pixel block and loading second-type gray-scale signals to the remaining unit pixels of the pixel block based on a preset rule, where the first-type gray-scale signals are not equal to the corresponding second-type gray-scale signals. It will be understood by those skilled in the art that all or part of the processes of the method of the embodiments described above may be implemented by instructing relevant hardware through a computer program, which may be stored in a non-volatile computer-readable storage medium, and when executed, may include the processes of the method of the embodiments described above. Any reference to memory, storage, database or other medium used in the embodiments provided herein can include non-volatile and/or volatile memory. Non-volatile memory can include Read-Only Memory (ROM), Programmable ROM (PROM), Electrically Programmable ROM (EPROM), Electrically Erasable Programmable ROM (EEPROM), or flash memory. Volatile memory can include Random Access Memory (RAM) or external cache memory. By way of illustration rather than limitation, RAM is available in a variety of forms such as Static RAM (SRAM), Dynamic RAM (DRAM), Synchronous DRAM (SDRAM), Double Data Rate SDRAM (DDRSDRAM), Enhanced SDRAM (ESDRAM), Synchronous Link (Synchlink), Synchronous Link DRAM (SLDRAM), Rambus Direct RAM (RDRAM), Direct Rambus Dynamic RAM (DRDRAM), and Rambus Dynamic RAM (RDRAM).

The technical features of the embodiments described above can be combined arbitrarily. For the sake of brevity, all possible combinations of the technical features of the above embodiments are not described, and such combinations of the technical features shall be deemed to fall within the scope of the present disclosure as long as there is no contradiction.

The embodiments described above only describe several implementations of the present disclosure, and the description thereof is specific and detailed. However, those cannot be therefore construed as limiting the scope of the disclosure. It should be noted that, for those of ordinary skill in the art, several variations and modifications can be made without departing from the concept of the present disclosure, which also fall within the scope of the present disclosure. Therefore, the protection scope of the present application shall be defined by the appended claims.

What is claimed is:

1. A pixel driving method, comprising:

acquiring a pixel signal of each unit pixel in a pixel block;

acquiring a first average pixel signal of the pixel block based on the pixel signal of each of the unit pixels in the pixel block;

if a signal determination interval corresponding to the first average pixel signal is a first-type interval, determining that the pixel signal of the pixel block meets a first condition, wherein the signal determination interval comprises the first-type interval, and the first condition is configured to represent the graininess of the pixel block during display; and if determining that the pixel signal of the pixel block meets the first condition, loading first-type gray-scale signals to a part of unit pixels of the pixel block and loading second-type gray-scale signals to the remaining unit pixels of the pixel block based on a preset rule, wherein the first-type gray-scale signals are not equal to the corresponding second-type gray-scale signals;

wherein the unit pixel comprises a red sub-pixel, a green sub-pixel and a blue sub-pixel, and the pixel driving method further comprises:

if the signal determination interval corresponding to the first average pixel signal is a second-type interval, determining that the pixel signal of the pixel block does not meet a first condition, wherein the signal determination interval comprises the second-type interval; and if determining that the pixel signal of the pixel block does not meet the first condition, loading the first-type gray-scale signal and the second-type gray-scale signal respectively to two adjacent same-color sub-pixels of each of the first grouping units in the pixel block;

wherein the first grouping unit comprises two adjacent unit pixels, and no same unit pixel exists in each of the first grouping units.

2. The pixel driving method according to claim 1, wherein the step of acquiring the first-type gray-scale signal and the second-type gray-scale signal comprises:

if determining that the pixel signal of the pixel block meets the first condition, acquiring an average pixel signal of each of the second grouping units in the pixel block, wherein the second grouping unit comprises four adjacent unit pixels, and no same unit pixel exists in each of the second grouping units; and acquiring the first-type gray-scale signal and the second-type gray-scale signal corresponding to the average pixel signal of each of the second grouping units by looking up a table.

3. The pixel driving method according to claim 1, wherein the step of acquiring the first-type gray-scale signal and the second-type gray-scale signal comprises:

if determining that the pixel signal of the pixel block does not meet the first condition, acquiring an average pixel signal of each of the first grouping units in the pixel block; and acquiring the first-type gray-scale signal and the second-type gray-scale signal corresponding to the average pixel signal of each of the first grouping units by looking up a table.

4. The pixel driving method according to claim 1, wherein before the step of acquiring a pixel signal of each unit pixel in a pixel block, further comprising:

loading a group of initial high and initial low gray-scale signals respectively to unit pixels in the first grouping unit of the pixel block, wherein the first grouping unit comprises two adjacent unit pixels, and no same unit pixel exists in each of the first grouping units.

5. A pixel driving apparatus, comprising:

a pixel signal acquisition circuit configured to acquire a pixel signal of each unit pixel in a pixel block;

an average pixel signal acquisition circuit configured to acquire a first average pixel signal of the pixel block based on the pixel signal of each of the unit pixels in the pixel block;

a graininess determination circuit configured to determine that the pixel signal of the pixel block meets a first condition when a signal determination interval corresponding to the first average pixel signal is a first-type interval, wherein the signal determination interval comprises the first-type interval, and the first condition is configured to represent the graininess of the pixel block during display; and a driving signal loading circuit configured to load first-type gray-scale signals to a part of unit pixels of the pixel block and loading second-type gray-scale signals to the remaining unit pixels of the pixel block based on a preset rule when determining that the pixel signal of the pixel block meets the first condition, wherein the first-type gray-scale signals are not equal to the corresponding second-type gray-scale signals;

wherein the unit pixel comprises a red sub-pixel, a green sub-pixel and a blue sub-pixel, and wherein when the signal determination interval corresponding to the first average pixel signal is a second-type interval, the graininess determination circuit is configured to determine that the pixel signal of the pixel block does not meet a first condition, wherein the signal determination interval comprises the second-type interval; and in response to determining the pixel signal of the block does not meet the first condition, the driving signal loading circuit is configured to load the first-type gray-scale signal and the second-type gray-scale signal respectively to two adjacent same-color sub-pixels of each of the first grouping units in the pixel block;

wherein the first grouping uinit comprises two adjacent unit pixels, and no same unit pixel exists in each of the first grouping units.

6. A computer device comprising a memory having computer-readable instructions stored therein and one or more processors, wherein the computer-readable instructions, when executed by the one or more processors, cause the one or more processors to perform the steps of:

acquiring a pixel signal of each unit pixel in a pixel block;

acquiring a first average pixel signal of the pixel block based on the pixel signal of each of the unit pixels in the pixel block;

if a signal determination interval corresponding to the first average pixel signal is a first-type interval, determining that the pixel signal of the pixel block meets a first condition, wherein the signal determination interval comprises the first-type interval, and the first condition is configured to represent the graininess of the pixel block during display; and if determining that the pixel signal of the pixel block meets the first condition, loading first-type gray-scale signals to a part of unit pixels of the pixel block and loading second-type gray-scale signals to the remaining unit pixels of the pixel block based on a preset rule, wherein the first-type gray-scale signals are not equal to the corresponding second-type gray-scale signals;

wherein the processor, when executing the computer readable instructions, further performs the steps of:

if the signal determination interval corresponding to the first average pixel signal is a second-type interval, determining that the pixel signal of the pixel block does not meet a first condition, wherein the signal determination interval comprises the second-type interval; and if determining that the pixel signal of the pixel block does not meet the first condition, loading the first-type gray-scale signal and the second-type gray-scale signal respectively to two adjacent same-color sub-pixels of each of the first grouping units in the pixel block;

wherein the first grouping unit comprises two adjacent unit pixels, and no same unit pixel exists in each of the first grouping units.

* * * * *